US009273471B2

(12) United States Patent
Fischer

(10) Patent No.: US 9,273,471 B2
(45) Date of Patent: Mar. 1, 2016

(54) NON-SLIP SURFACES AND METHODS FOR CREATING SAME

(71) Applicant: George L. Fischer, Long Valley, NJ (US)

(72) Inventor: George L. Fischer, Long Valley, NJ (US)

(73) Assignee: George L. Fischer, Long Valley, NJ (US)

( * ) Notice: Subject to any disclaimer, the term of this patent is extended or adjusted under 35 U.S.C. 154(b) by 0 days.

(21) Appl. No.: 14/303,683

(22) Filed: Jun. 13, 2014

(65) Prior Publication Data

US 2014/0366467 A1 Dec. 18, 2014

Related U.S. Application Data

(60) Provisional application No. 61/835,296, filed on Jun. 14, 2013.

(51) Int. Cl.

| | |
|---|---|
| ***E04F 15/02*** | (2006.01) |
| ***E04F 15/22*** | (2006.01) |
| ***A47G 27/02*** | (2006.01) |

(52) U.S. Cl.

CPC ..... *E04F 15/02172* (2013.01); *A47G 27/0225* (2013.01); *E04F 15/02038* (2013.01); *E04F 15/02183* (2013.01); *E04F 15/02188* (2013.01); *E04F 15/22* (2013.01)

(58) Field of Classification Search

CPC ..... E01C 13/045; E01C 13/08; E01C 13/065; E04F 15/225; E04F 19/026; A47C 23/063; A47C 31/123

USPC ..... 52/177–181, 403.1; 5/265, 641, 230, 5/231, 247, 944; 473/92

See application file for complete search history.

(56) References Cited

U.S. PATENT DOCUMENTS

| | | | | |
|---|---|---|---|---|
| 2,421,171 | A * | 5/1947 | Trautvetter et al. | 52/180 |
| 3,656,190 | A * | 4/1972 | Regan et al. | 5/613 |
| 4,654,989 | A | 4/1987 | Fleming | |
| 4,727,697 | A | 3/1988 | Vaux | |
| 4,930,286 | A | 6/1990 | Kotler | |
| 6,742,202 | B2 * | 6/2004 | Jones | 5/263 |
| 6,903,871 | B2 | 6/2005 | Page | |
| 7,900,416 | B1 | 3/2011 | Yokubison et al. | |

(Continued)

FOREIGN PATENT DOCUMENTS

| | | |
|---|---|---|
| EP | 1385134 A2 | 1/2004 |
| EP | 2014217 A1 | 1/2009 |

(Continued)

*Primary Examiner* — Joshua J Michener
*Assistant Examiner* — Kyle Walraed-Sullivan
(74) *Attorney, Agent, or Firm* — Rita C. Chipperson; Chipperson Law Group, P.C.

(57) ABSTRACT

Disclosed are surface sections for creating a non-slip or minimal slippage surface. The surface section includes a plate, a plurality of plate apertures, at least one elevator, a plurality of pegs, and a plurality of couplers to couple the pegs to the plate. Each of the plurality of pegs is at least partially located within, and aligned with, one of the plate apertures. Each coupler couples one of the plurality of pegs to the plate in a normal, extended state in which at least a portion of the peg is extended above the upwardly facing surface of the plate. Each coupler allows each of the plurality of pegs to move within its respective plate aperture to a non-extended state upon application of pressure to the peg. When the pressure is removed, the coupler moves the peg back to its normal, extended state.

11 Claims, 4 Drawing Sheets

(56) References Cited

U.S. PATENT DOCUMENTS

| | | | | |
|---|---|---|---|---|
| 8,099,915 | B2 | 1/2012 | Moller, Jr. et al. | |
| 2005/0193669 | A1 | 9/2005 | Jenkins et al. | |
| 2006/0230531 | A1* | 10/2006 | Caon | 5/241 |

FOREIGN PATENT DOCUMENTS

| | | | |
|---|---|---|---|
| GB | 2189991 | A | 11/1987 |
| JP | 2001224548 | A | 8/2001 |
| JP | 2002369785 | A | 12/2002 |

* cited by examiner

NON-SLIP SURFACES AND METHODS FOR CREATING SAME

BACKGROUND OF THE INVENTION

Embodiments of the present invention generally relate to non-slip surfaces and methods for creating same. More specifically, the present invention relates to non-slip surfaces and methods for creating same utilizing a plurality of pegs and a surface including a plurality of apertures.

Non-slip surfaces and/or products are known that utilize anti-slip techniques to prevent slips and falls. One such technique for creating a non-slip surface is to increase its normal force or the coefficient of friction such that the surface creates an indirect horizontal force. Frictional force equals the product of the coefficient of friction and the normal force: $F_{fr}=\mu_s F_N$. The coefficient of static friction may be increased, for example, by including sharp or rough features in the surface, however, such features can cut or damage objects placed upon such surface, or can accelerate the wear of such objects (e.g., shoes). Even if the primary object to be placed upon such a surface (e.g., a shoe) is ruggedized, secondary objects (e.g., hands) can be injured or damaged by the sharp or rough features if, for example, a fall should occur. Surfaces with a high coefficient of friction can also become coated by a film of a material having a low coefficient of friction such as water, frost, mud, grease, or oil, which may act to undermine the non-slip properties of the surface.

One solution known in the art to create a non-slip surface by increasing the surface's coefficient of friction is to place non-slip devices such as spikes or bumps on the surface itself in locations that are likely to come into contact with a person's shoe or foot. These non-slip devices are typically seen, for example, on open metal or plastic steps and metal grate bridges. As such devices are designed to dig into a person's shoe or foot, they can have the undesirable effect of damaging the soles of the shoe or foot. The pressure exerted on a bare foot by the small contact area of the non-slip device can also be very painful.

Similarly, surfaces having integral non-slip devices are also known including, for example, diamond plates and plastic mats with raised circular bumps. Again, such surfaces are designed such that the raised diamonds or bumps deform the sole of a shoe or foot. These non-slip devices are always present, therefore, the walking surface is always uneven and may act as a tripping hazard. Also, some circular bumps of the plastic mats are sloped inward such that only a component of the force applied to an object in contact therewith is horizontal. This therefore requires that a large pressure be exerted by the object in contact with the surface in order to deform such object.

Other known anti-slip solutions include very rough, sandpaper-type surfaces such as those found on diving boards, boat footplates, bath tubs and similar locations. Such surfaces can cut bare feet, especially if the skin is softened due to, for example, exposure to water. Other objects or body parts can also be damaged if they come into contact with such surfaces, as, for example, at the end of a fall onto the surface.

In lieu of sharp or rough features, sticky surface coatings such as chemical coatings may be used to increase the coefficient of static friction of a surface. However, such coatings may wear off or adhere to objects that come into contact with the surface. Also, sticky coatings can make it difficult for the object to be removed from the surface. For example, it may be difficult and/or tiring for someone to walk on such a surface because greater force is required to pull each shoe from the surface's sticky coating. Such surfaces can also become coated with dust, dirt, or a slippery material, which may act to reduce the coefficient of friction of such surface, thereby defeating or minimizing the effect of the non-slip surface.

Also, it is known to use non-slip devices such as shoes having integral cleats or spikes, or studded snow tires for cars, on traditional surfaces. Such devices are designed to deform, or dig into, the surface with which they are in contact to create a higher coefficient of friction for the surface. The sides of the cleat, for example, can provide a horizontal force on a surface; however, cleats must penetrate such surface in order to function properly. These repeated penetrations can damage or destroy the surfaces upon which they are used. Hence, the use of such devices is limited to the greatest extent possible. For example, athletes are not typically allowed to enter buildings while wearing cleats, and studded snow tire use is typically limited to winter months. In addition, if the surface in contact with such devices is too hard, the gripping function is compromised as such devices are unable to achieve sufficient penetration. Also, the protrusions on such devices are subjected to exertion and large pressures, thus they tend to wear away or become damaged in addition to damaging the surfaces with which they are in contact.

Alternate non-slip equipment is also known such as electro-magnetic shoes utilized with steel surfaces or suction cups utilized with glass surfaces. The attraction between the shoes and/or cups and the surface is sufficiently strong to minimize the potential for disengagement from the floor, and thereby a fall. Such equipment is typically expensive, limited in locations of use, and requires the users to be specifically trained.

Similarly, it is known to use mechanical locks coupled to a surface wherein a shoe or the like is clicked into the lock to prevent it from dislodging therefrom until the user chooses to physically unlock it. Racing bicycles, skis, and certain NASA weightless space applications utilize such mechanical locks to lock shoes or boots into place. Freedom of movement and selection of foot placement is extremely limited in these applications as the locks do not conform to, or otherwise protect, the shoe or boot. Also, they require the object to be correctly positioned and oriented in order to lock and unlock the object in place. Sometimes it may be difficult for the object (e.g., a shoe) to disengage from the surface quickly, for example, in an emergency situation which may cause injury to a user. Further, lock-in surfaces only work if the shoe/boot and the lock match.

BRIEF SUMMARY OF THE INVENTION

Briefly stated, in one aspect of the present invention, an apparatus for creating a non-slip or minimal slippage surface is provided. The apparatus includes a plate, the plate having an upwardly facing surface, a downwardly facing surface, and a plurality of plate apertures; at least one elevator coupled to the underside of the plate; a plurality of pegs, each of the plurality of pegs at least partially located within, and aligned with, one of the plurality of plate apertures; and a plurality of couplers, each of the plurality of couplers coupling one of the plurality of pegs to the plate in a normal state in which at least a portion of each of the plurality of pegs is extended above the upwardly facing surface, each of the plurality of couplers allowing each of the plurality of pegs to move within the plurality of plate apertures to a non-extended state upon application of pressure to the plurality of pegs.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
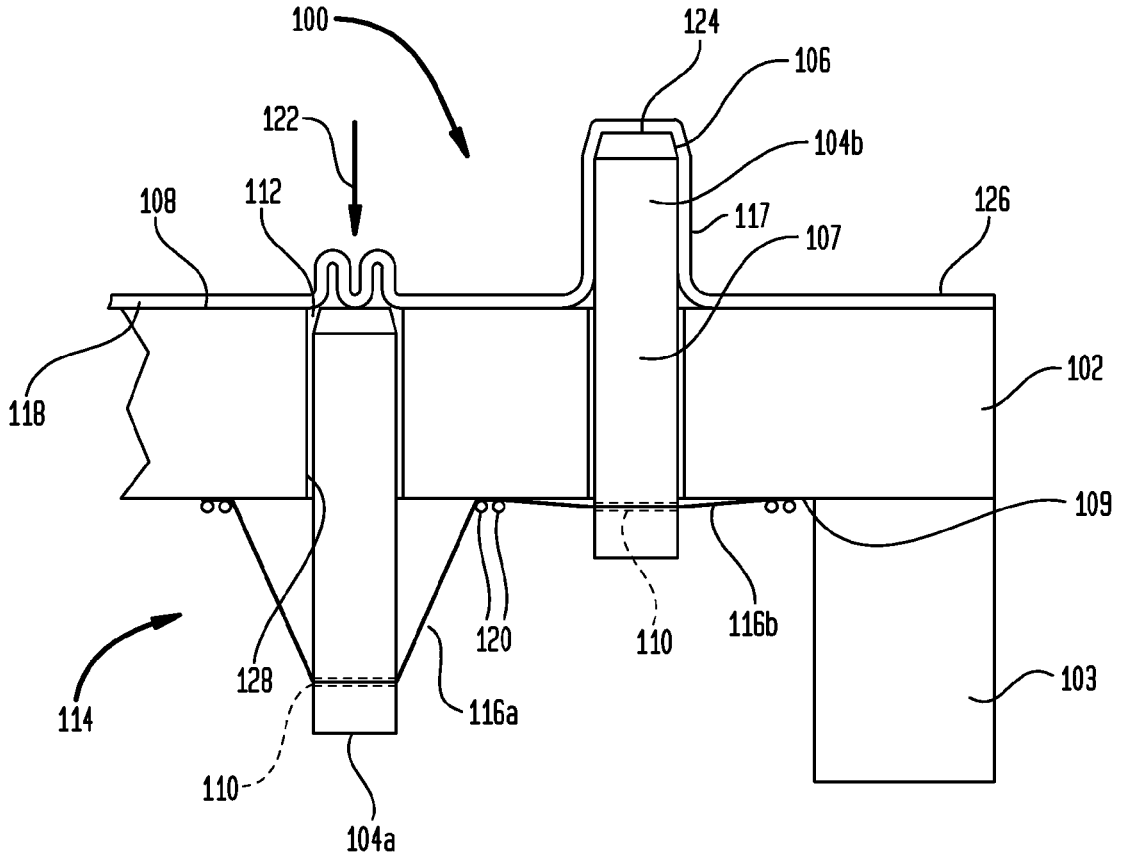
FIG. 1 depicts a side view of a portion of an exemplary non-slip surface section in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a peg" may include a plurality of pegs. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Disclosed herein are apparatus and methods for creating a non-slip or minimal slippage surface. In one embodiment of the present invention, the apparatus includes a plate including an array of apertures, an array of pegs that correspond to the array of apertures, and a coupler that couples each peg to a respective aperture. The plate has an upwardly facing surface and a downwardly facing surface. In one embodiment, the coupler is an elastic member that maintains its respective peg in an extended position (i.e., the top of the peg is located above the upwardly facing surface of the plate) when no substantially downward pressure is applied to the peg. When substantially downward pressure is applied to the peg, the coupler allows the peg to move substantially downward under the force of the pressure until the upwardly facing surface of the peg is substantially flush with the upwardly facing surface of the plate and/or the object that is applying the pressure to the peg. In such embodiments, the coupler acts in a spring-loaded manner, whether under the control of a spring or non-spring coupling device.

The surface of the present invention has a wide variety of applications including, without limitation, locker rooms, showers, bathroom floors, saunas, swimming pool decks, construction or emergency vehicle ladders or steps, public steps, hilly walkways, ship decks, supermarkets, and high-traffic areas. The present invention also has many non-foot traffic applications as discussed in greater detail below.

Referring now to FIGS. 1 through 4, FIG. 3 depicts a top view of an exemplary non-abrasive, non-slip surface section 100 in accordance with one embodiment of the present invention. Surface section 100 includes a plate 102, a plurality of pegs 104, a plurality of couplers 114, and one or more elevators 103.

Referring now to FIG. 1, depicted is a side view of a portion of one exemplary non-slip or minimal slippage surface section 100 (or a portion thereof) in accordance with one embodiment of the present invention. In this exemplary embodiment, the surface is created via one or more such surface sections 100. In the depicted embodiment and as best seen in the top view of FIG. 3, surface sections 100 are substantially rectangular to allow multiple plates to be easily arranged to create a large surface, however, alternate shapes may be substituted including, without limitation, square, hexagonal, circular, triangular, oval, and custom. Also, use of a modular system in which a plurality of surface sections 100 creates a surface allows any such section to be easily swapped with another section for cleaning or maintenance purposes. Surface sections 100 may be installed, for example, atop the surface for which the slip protection is desired (e.g., pool deck, walkway, etc.).

In one embodiment of the present invention, plate 102 is a hollow plate that includes a light weight support matrix that reinforces upwardly facing surface 108 of plate 102 and inwardly facing surfaces 128 of plate apertures 112. Sturdy inwardly facing surfaces 128 provide rigidity to pegs 104 as they move between their extended and non-extended positions as discussed in greater detail below.

Plate 102 has a substantially continuous upward facing surface 108 with the exception of plate apertures 112 and pegs 104 in order to provide, inter alia, a comfortable surface upon which to walk in bare feet. Plate 102 is made of plastic such as water-resistant plastics such as high density polyethylene ("HDPE"). However, alternate materials may be substituted including, without limitation, carbon fiber and aluminum. Also, embodiments of the present invention are envisioned in which upwardly facing surface of 108 is made of a different material than the other portions of plate 102.

Plate 102 includes a plurality of plate apertures 112 arranged in an array. In the depicted embodiment, the center of each peg 104 is offset from the center of adjacent pegs in the same column by a distance of one (1) inch. However, alternate distances may be substituted without departing from the scope hereof. In the depicted embodiment, the first column 115 of apertures 112 and every other column of apertures 112 therefrom (e.g., the third column, fifth column, seventh column, ninth column, etc.) (the "odd columns") are substantially longitudinally aligned. Similarly, the second column 116 of apertures 112 and every alternating column of apertures 112 therefrom (e.g., the fourth column, sixth column, eighth column, tenth column, etc.)(the "even columns") are also substantially longitudinally aligned. However, these even columns are offset latitudinally from the odd columns such that each even aperture (i.e., the apertures located in an even column) is approximately latitudinally centered between its adjacent odd apertures (i.e., the apertures located in an odd column) with the exception of the apertures located at one of the latitudinal ends of the even columns. Similarly, the odd columns are offset latitudinally from the even columns such that each odd aperture is approximately latitudinally centered between its adjacent even apertures with the exception of the apertures located at one of the latitudinal ends of the odd columns. This array allows the pegs to be located in close proximity to each other, however, alternate arrays may be substituted without departing from the scope hereof.

In some embodiments of the present invention, plate 102 includes a covering 118 that includes a plurality of fingers 117, is approximately equivalent in size to plate 102, and covers upwardly facing surface 108 and all of the components of plate 102 (e.g., plate apertures 112 and pegs 104). Covering 108 acts to prevent dirt, moisture and other contaminants from entering plate apertures 112 as such contaminants may interfere with, or reduce the effectiveness of, the operation of pegs 104 as described in greater detail below. For example, such contaminants may cause one or more pegs to become stuck in place such that the peg no longer moves between its extended and non-extended states.

In the depicted embodiment, covering 108 is made of an elastic material such as latex, however, other materials may be substituted without departing from the scope hereof. In the depicted embodiment, covering 108 includes a plurality of preformed fingers 117 that allow pegs 104 to move freely between their extended and non-extended states. This allows covering 108 to accommodate the movement of the pegs 104 when substantially upward pressure is applied thereto by one or more couplers 114. However, coverings that do not include preformed fingers may be substituted without departing from the scope hereof. Also, covering 108 is not required to implement the present invention. Alternate embodiments are also envisioned in which covering 108 covers only one or more portions of plate 102 without departing from the scope hereof.

Referring back to FIG. 1, surface section 100 includes a plurality of pegs 104, such pegs 104 becoming spring-loaded when utilized in conjunction with coupler 114 and plate 102 as described herein. In one embodiment of the present invention, pegs 104 are made of plastic (e.g., water-resistant plastics such as high density polyethylene ("HDPE")), but alternate materials may be substituted including, without limitation, carbon fiber and aluminum. In the depicted embodiment, the use of such materials minimizes the potential for swelling of plates 102 and/or pegs 104 due to humidity and/or moisture.

In the depicted embodiment, pegs 104 are substantially cylindrical, have a substantially circular cross-section, and taper radially inward at topmost end 106 such that topmost end 106 is beveled. However, alternate embodiments are envisioned in which the bodies 107 of pegs 104 have varying cross-sections including, but not limited to, square, rectangular, and hexagonal. Also, alternate embodiments are envisioned in which topmost ends 106 have varying shapes, with or without tapering, including, but not limited to, semi-spherical. Also, in the depicted embodiment, the body of pegs 104 have a diameter of approximately three-eighths (3/8) inches, however, alternate dimensions may be substituted without departing from the scope hereof. Such dimensions may be varied, for example, based upon the type of object (e.g., bare feet, work boots, vehicle tires, cargo, etc.) to be placed upon the surface section.

In the depicted embodiment, the quantity of pegs 104 is equal to the quantity of plate apertures 112; however, alternate embodiments are envisioned in which the quantity of pegs 104 is less than the quantity of plate apertures 112.

Figure 2:
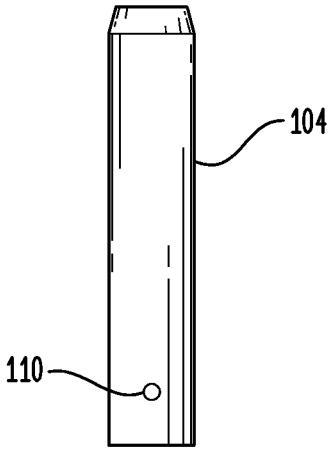
FIG. 2 depicts a side view of a peg of the non-slip surface section shown in FIGS. 1 through 4 in accordance with one embodiment of the present invention.
Figure 3:
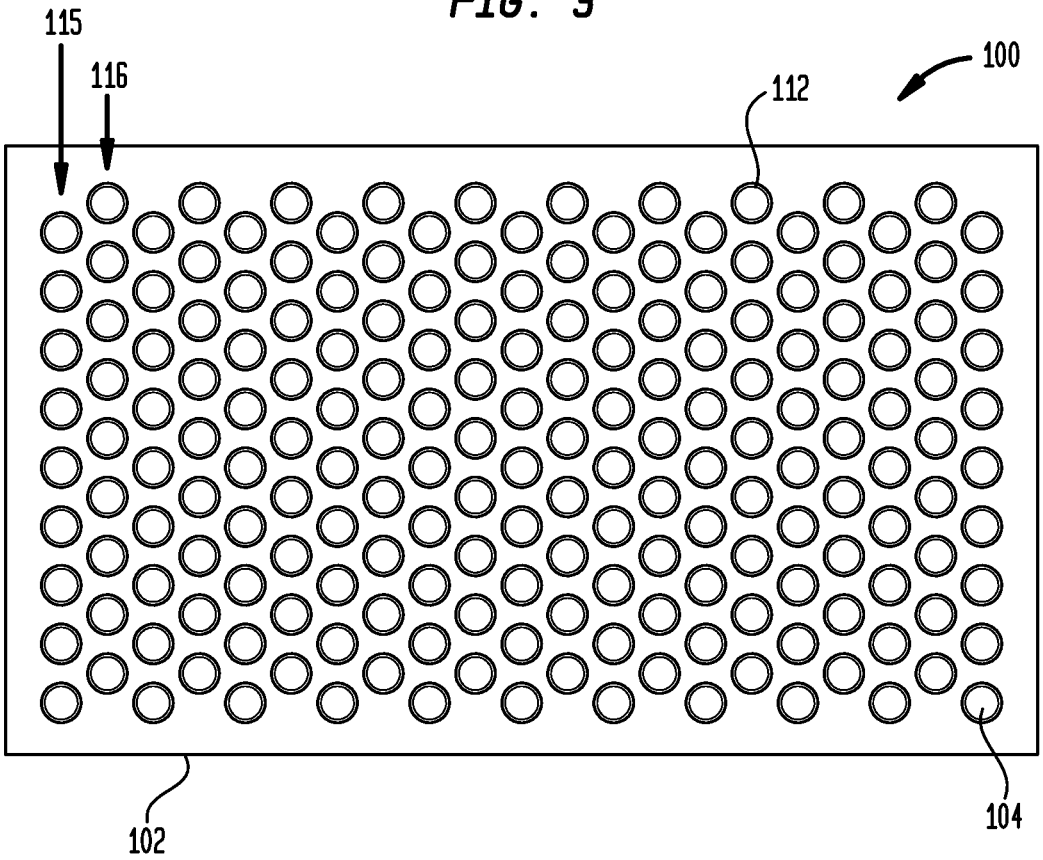
FIG. 3 depicts a top view of the exemplary non-slip surface section of FIGS. 1 through 4 in accordance with one embodiment of the present invention.

Referring now to FIG. 2, depicted is a side view of an exemplary peg 104 and an end view of coupling aperture 106, which passes through the bottommost end of peg 104. In the depicted embodiment of the present invention, coupler 114 passes through coupling aperture 110 to minimize the possibility that coupler 114 becomes disengaged from peg 104. Pegs 104 include substantially cylindrical coupling apertures 110, however, such apertures may have varying shapes without departing from the scope hereof. Also, alternate methods of coupling coupler 114 to peg 104 may be substituted including, without limitation, attachment of coupler 114 directly to an exterior surface of peg 104 via adhesive or the like.

Figure 4:
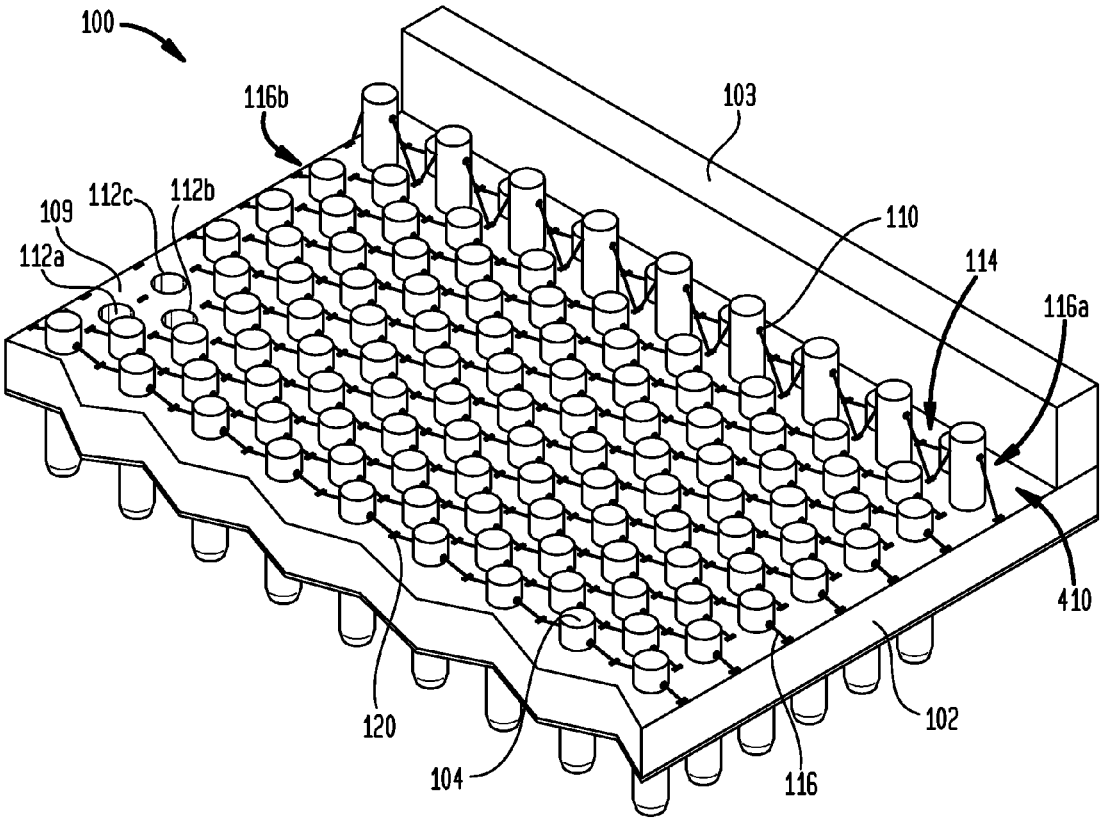
FIG. 4 depicts a bottom view of a portion of the exemplary non-slip surface section of FIGS. 1 through 4 in accordance with one embodiment of the present invention.

Turning now to FIG. 4, in the depicted embodiment, each peg is coupled to surface section 100 and its respective plate aperture 112 via one or more couplers 114. FIG. 4 depicts a bottom view of the surface section 100 depicted in FIGS. 1 through 4. In the depicted embodiment, coupler 114 is one or more elastic cords 116 attached to downwardly facing surface 109 of plate 102 via one or more anchors 120 located on opposing sides of plate aperture 112. In the depicted embodiment, anchors 120 are a pair of staples that keep cords 116 under tension such that they are taut. However, alternate anchors may be substituted without departing from the scope hereof.

The embodiment of the present invention shown in FIGS. 1 through 4 is created by inverting surface section 100 on an assembly surface. Pegs 104 are then also inverted and placed in their corresponding peg apertures 112. The assembly surface prevents the pegs from falling through peg aperture 112. Coupler 114 is then created by passing a length of elastic cord 116 though a plurality of substantially horizontally aligned coupling apertures 110. Elastic cord 116 is then anchored to downwardly facing surface 109 of surface section 100 via a plurality of anchors such as, but not limited to, staples. In FIG. 4, for illustrative purposes, the pegs 104 associated with cord **116*a* are shown in their non-extended states and the pegs associated with cords 116*b*** are shown in their extended states.

In the depicted embodiment, two staples are utilized on substantially opposed sides of peg aperture 112 to couple cord 116 to surface section 100, and such staples are substantially aligned with cord 116. However, alternate methods of coupling cord 116 may be substituted without departing from the scope hereof. Also, embodiments are envisioned in which a plurality of cords is utilized in place of a single cord.

In the depicted embodiment of the present invention, and as also best seen in FIG. 4, surface section 100 includes a plurality of elevators 103 (only one of which is shown in FIG. 4) coupled to the underside thereof. Elevators 103 raise plate 102 to a height above the ground or other surface upon which surface section 100 is utilized to create a hollow cavity in which pegs 104 have sufficient space for proper operation. In the depicted embodiment, elevators 103 are substantially rectangular sections made of the same material as plate 102 that extend throughout the length of both of the longitudinal edges of plate 102. However, alternate embodiments are envisioned in which elevators surround varying edges or all edges of plate 102 without departing from the scope hereof. The height of elevators 103, and therefore hollow cavity 410, is of sufficient height to allow each peg to move to a non-extended state below downwardly facing surface 109 of plate 102 whenever pressure is applied to the top of the respective peg 104. For example, for pegs having a height of one-half inch (½") above upwardly facing surface 109 of plate 102, an elevator having a height of three-quarters of an inch (¾") may be utilized. However, elevators having alternate shapes, lengths, and locations may be substituted without departing from the scope hereof.

As seen in the side view of surface section 100 shown in FIG. 1, each peg 104 is at least partially located in a plate aperture 112 of surface section 100. The peg is held to surface 100 via one or more couplers 114 as discussed in greater detail above. In its normal state, peg 104 is extended such that its top end 106 is located above upwardly facing surface 108 of surface section 100 as is shown for peg 104*b* of FIG. 1. When a force 122 is applied to the top of peg 104 (e.g., the force of a foot stepping on surface section 100), it is moved from its extended state to its non-extended state, the latter of which is the position shown for peg 104*a*. The elasticity of coupler 114 allows peg 104 to move to a non-extended state under the application of force 122 while also returning peg 104 to its normal, extended state as soon as the substantially downward force 122 is removed. That is, when there is no force applied to peg 104, elastic cord(s) 116 contract to their original state as shown for elastic cord(s) 116*b* which forces peg 104 upward through its respective substantially cylindrical plate aperture 112. When a force is applied to peg 104, peg 104 is pushed downward through plate aperture 112 until the point at which upwardly facing surface 124 of peg 104 (or the covering 118 thereupon) is substantially flush with upwardly facing surface 108 of plate 102 and/or the portion of upwardly facing surface 126 of covering 108 adjacent to the respective peg aperture 112. This applies force to cord(s) 116, and the elasticity of cord(s) 116 allows the cord(s) to expand to their expanded state as shown for elastic cord(s) 116*a*. Again, when the force is removed from peg 104, cord(s) 116 contract back to a contracted state, thereby pushing the peg 104 upward through its respective plate aperture 112 to its extended position.

In the depicted embodiment, upwardly facing surfaces 124 of pegs 104 are located at a height of approximately one-half (½) inch above upwardly facing surface 126 of the portion of covering 108 located adjacent the respective peg aperture 112 when peg 104 is in its normal extended state. In the depicted embodiment of the present invention, this height is relatively low to the surface as to not impede activities performed thereon such as walking, running, etc. However, alternate extensions and/or heights may be substituted without departing from the scope hereof.

Also, peg 104 has a diameter and shape that is approximately equivalent, yet slightly smaller than, inwardly facing surface 128 of plate aperture 112. This maintains peg 104 in a substantially upright position, with zero or minimal side-to-side movement thereof, as elastic cord(s) 116 are contracted and expanded and pegs are moved between extended and non-extended states to provide a stable surface for which pegs 104 are not jiggling side to side. However, alternate embodiments are envisioned in which the diameter and shape of peg 104 varies more substantially from its respective plate aperture 112.

When one or more surface sections 100 are combined, a non-slip or minimal slippage surface is created. In one exemplary embodiment, surface sections 100 may be utilized to create a walkway. In such a scenario, when a shoe or foot lands on the surface, it depresses the plurality of pegs located underneath the shoe or foot to their non-extended positions, however, the pegs surrounding the shoe or foot will remain in their extended positions. In this manner, a wall or barrier of pegs surrounds the shoe or foot. The pegs forming the wall or barrier of pegs will not compress since there is no downward force being applied to them even in situations in which a horizontal force may be applied to them by the object placed on the surface.

If the shoe, foot, or other object should start to slip, it will contact the wall or barrier of fully extended pegs, which will act to stop or otherwise impede the slipping motion. That is, since the horizontal force associated with slipping is exerted at an angle of approximately ninety (90) degrees relative to the vertical force required to depress the pegs (e.g., pegs 104) to a non-extended state, the two forces are substantially orthogonal, and therefore, substantially de-coupled. Therefore, a peg such as peg 104, which only requires a small force to be depressed, can exert a large horizontal force on an object that is sliding substantially horizontally into the peg. The horizontal force exerted by the peg on the sliding object is a substantially equal and opposite reaction force, therefore, it only exists if the object is sliding into the peg, such as would occur during the first moments of a fall.

In this manner, the surface created via one or more surface sections 100 is a non-slip or minimal slippage surface. Importantly, although a wall or barrier of pegs surrounds the shoe or foot (or other object placed upon such a surface), the shoe, foot, or other object remains free to move (i.e., it is not locked into a fixed position) with a full range of mobility (i.e., it is not impeded in any manner other than a horizontal slide). Activities such as walking, running, etc. are not impeded via use of many embodiments of the surface of the present invention since the height of the peg is relatively low and requires minimal vertical movement of the object to avoid interference with the peg. However, alternate embodiments are envisioned in which the height of the extended peg above the surface may require irregular motion such as high steps and the like.

Also, the surface is substantially non-abrasive. If a person were to fall on the surface of the present invention, the pegs would not cause any harm to the falling person and would likely act to cushion the fall (i.e., the level of cushioning provided, if any, would vary depending upon various features of the surface section including, without limitation, material and dimensions).

The depicted embodiment and the preceding shapes and dimensions are compatible for use in areas in which people will traverse the surface in bare feet, for example, swimming pool decks. The beveled edges of the topmost ends of the pegs and relatively large diameter of the pegs minimize the potential for injury to a bare foot if one or more of the pegs 104 malfunctions (i.e., it does not move to its full non-extended position when a downward force is applied by the foot to the peg 104). Also, the height of the pegs above plate 102 is relatively low to increase the likelihood that the object being placed upon the surface is in its near final position before it begins to apply a downward pressure to pegs 104. Similarly, this relatively low position minimizes or eliminates the possibility that the object applies a horizontal force to the pegs before it is nearly in its final, landed position. That is, at the point at which the object is almost in its final position, it should be moving substantially in a vertical motion.

Figure 5A:
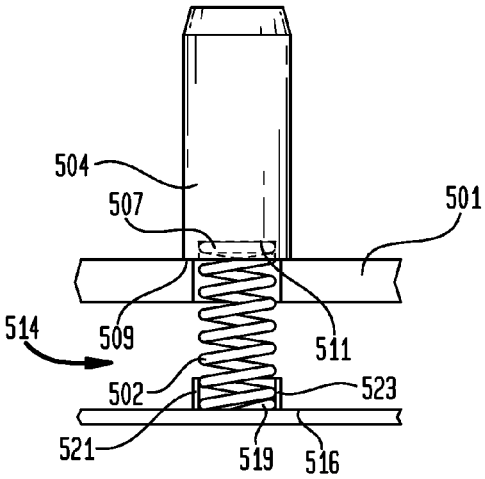
FIG. 5A depicts an alternate coupler in accordance with an alternate embodiment of the present invention.

Referring now to FIG. 5A, depicted is an alternate embodiment for a coupler that may be utilized with a surface section such as surface section 100 as described above. Alternate coupler 514 incorporates a spring 502 and spring housing 521, and it is utilized with a peg such as peg 504. Peg 504 is substantially identical to peg 104 as discussed above with the exception that it includes a spring cavity 507 in lieu of a coupling aperture 110. That is, in lieu of a coupling aperture 110, peg 504 includes a substantially cylindrical spring cavity that is recessed into downwardly facing surface 509 of peg 504 in a manner in which it is substantially centered therein.

Spring cavity 507 has a diameter slightly larger than the diameter of spring 502. Spring cavity 507 accepts top end 511 of spring 502, which is coupled to spring cavity 502 via an adhesive or the like to prevent or minimize the potential for dislodgement of spring 502 therefrom. However, alternate embodiments of coupling spring 502 to peg 504 may be substituted without departing from the scope hereof.

Bottom end 519 of spring 502 is located internal to spring housing 521, which is also substantially cylindrical and has a diameter slightly larger than the diameter of spring 502. Spring housing 521 sits atop and is coupled to floor 516 of surface section 500 and has a relatively thin wall 523 that retains spring 502 in an upright position when spring 502 is placed therein. Spring 502 is also coupled to the portion of floor 516 located internal to spring housing 521 to prevent or minimize the potential for dislodgement of spring 502 therefrom. However, alternate embodiments of the present invention may omit spring housing 521. In such embodiments, spring 502 may be held to floor 516, for example, via a fastener, adhesive, or the like.

Figure 5B:
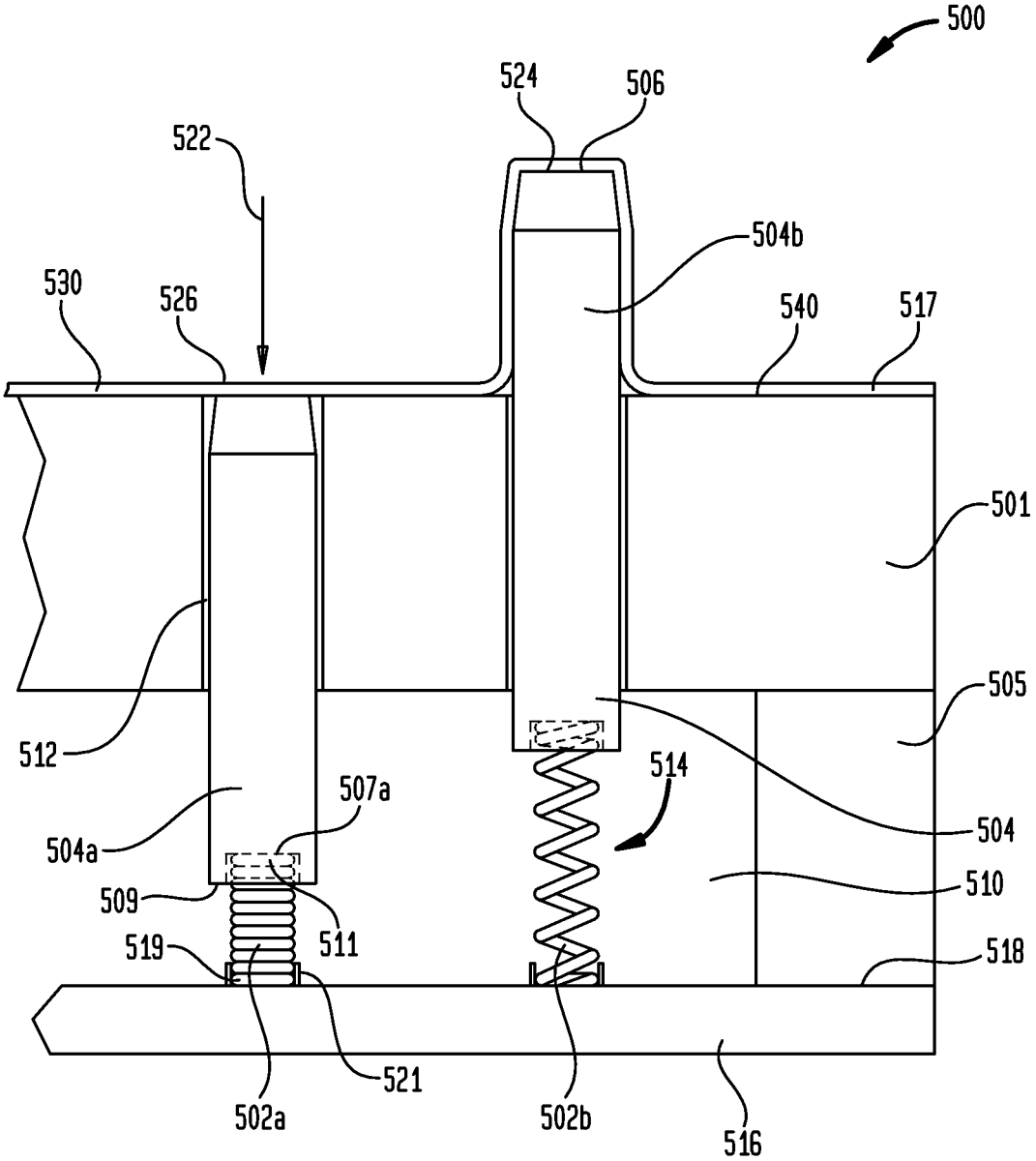
FIG. 5B depicts a side view of a portion of an exemplary non-slip surface section in accordance with an embodiment of the present invention utilizing the coupler of FIG. 5A.

As best seen in the side view of surface section 100 shown in FIG. 5B, surface section 500 and all of the components thereof are substantially identical to surface section 100 as described in detail above with the exception of coupler 114 and floor 516. Floor 516 may be substantially rectangular and of the same material as plate 102, and, in the depicted embodiment, it is attached to the downwardly facing surface(s) 518 of elevator(s) 505 such that floor 516 and elevators 505 surround cavity 510. Embodiments of the invention are envisioned in which cavity 510 is fully enclosed (e.g., for protection from its environment) or partially enclosed (e.g., for ventilation).

Each peg 504 is at least partially located in a plate aperture 512 of surface section 500. Each peg is held to surface section 500 via one or more couplers 514 as discussed in greater detail above. In its normal state, peg 504 is extended such that its top end 506 is located above upwardly facing surface 508 of surface section 500 as is shown for peg 504*b* of FIG. 5B. When a force 522 is applied to the top of a peg 504 (e.g., the force of a foot stepping on surface section 500), peg 504 is moved from its extended state to its non-extended state as shown for peg 504*a*. Spring 502 of coupler 514 allows peg 504 to move to a non-extended state under the application of force while also returning peg 504 to its normal, extended state as soon as the substantially downward force 522 is removed. That is, when there is no force applied to peg 504, spring 502 expands fully, or to the greatest extent allowed based upon the configuration of surface section 500, as shown for spring 502*b*. This forces peg 504 upward through its respective substantially cylindrical plate aperture 512 to its extended position. When a force is applied to peg 504, peg 504 is pushed downward through plate aperture 512 until the point at which upwardly facing surface 524 of peg 504 (or the covering 530 thereupon) is substantially flush with upwardly facing surface 540 of plate 501 or the upwardly facing surface 526 of covering 530 adjacent the respective peg aperture 512. This applies force to spring 502, and spring 502 contracts to its contracted state as shown for spring 502*a*. Again, when the force is removed from peg 504, spring 504 expands back to an expanded state, thereby pushing peg 504 upward through its respective plate aperture 512 to its extended position.

In an alternate embodiment of the present invention depicted in FIGS. 5A and 5B, coupler 514 may be omitted in favor of a liquid. More specifically, floor 516, plate 501, covering 517, and elevators 505 may be formed such that cavity 510 is watertight and contains a liquid such as water or oil. In such an embodiment, pegs 504 are designed to be less dense than the liquid (e.g., pegs 504 may be hollow). The liquid in cavity 510 provides an upward buoyant force on each peg to maintain them, or return them to, their extended positions. Alternate liquids and watertight cavities may be substituted without departing from the scope hereof.

Cargo

In another use of the present invention, surface sections such as surface section 100 could be utilized on the interior surfaces of reusable shipping containers in order to prevent or minimize movement of fragile objects during transportation. That is, when the object to be shipped is placed in the shipping container, the pegs will conform to the outside perimeter of the object in order to retain the object in place. Further, palletized cargo could be lowered onto truck beds fitted with the surfaces of the present invention to prevent or minimize load shifting during transportation of the cargo. In such a use, pallet drivers are able to roll over the pegs during loading and unloading of the cargo without incident.

In its present form or with minor variations, the present invention has many uses for preventing objects from falling, slipping or rolling from a surface. For example, the present invention may be used as a serving tray or the like to minimize the potential for sliding of cups, glasses, or other dishes therefrom. Or, the present invention may be utilized to create an auto-sizing cup holder. These are just a few examples of the many applications of the present invention. The variations required to accommodate such varying uses may include, but are not limited to, varying heights of the pegs (in their extended positions) above the upwardly facing surface of the surface section, varying coupler spring forces, varying peg quantities, and varying peg spacing (relative to other pins).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus for creating a substantially non-slip surface comprising:

a plate, said plate having an upwardly facing plate surface and a downwardly facing plate surface, said upwardly facing plate surface forming said substantially non-slip surface, said plate including a plurality of plate apertures;

at least one elevator coupled to an underside of said plate;

a plurality of pegs, each of said plurality of pegs at least partially located within, and aligned with, a respective one of said plurality of plate apertures, said plurality of pegs movable between a normal state and an extended state, each of said plurality of pegs in said normal state having at least a portion thereof extended above said upwardly facing plate surface, each of said plurality of pegs in said non-extended state having an upwardly facing peg surface that is substantially flush with said upwardly facing plate surface; and a plurality of couplers, each of said plurality of couplers coupling a respective one of said plurality of pegs to said plate, each of said plurality of couplers allowing said respective one of said plurality of pegs to move within said respective one of said plurality of plate apertures from a normal state to a non-extended state upon application of pressure to said respective one of said plurality of pegs, wherein one or more of said plurality of pegs positioned in said normal state are located adjacent one or more of said plurality of pegs positioned in said non-extended state forming a wall to prevent slippage of an object applying pressure to said one or more of said plurality of pegs positioned in said non-extended state when said object is located above or upon said upwardly facing plate surface;

wherein each of said plurality of pegs includes a coupling aperture passing through a bottommost end; and wherein at least a portion of said coupler is located within said coupling aperture.

2. An apparatus according to claim 1 wherein said plurality of plate apertures and said plurality of pegs are substantially cylindrical.

3. An apparatus according to claim 1 wherein said applying pressure is a substantially downward application of pressure.

4. An apparatus according to claim 1 wherein each of said plurality of couplers is an elastic cord attached to said downwardly facing plate surface on opposing sides of a respective one of said plurality of plate apertures.

5. An apparatus according to claim 1, wherein said coupling aperture is substantially cylindrical.

6. An apparatus according to claim 1, wherein an approximate midpoint of each of said plurality of couplers is located within a respective one of said coupling apertures.

7. An apparatus according to claim 1, wherein said plurality of plate apertures are arranged in an array in which even columns of said plurality of plate apertures are offset from odd columns of said plurality of plate apertures.

8. An apparatus according to claim 7, wherein a majority of even plate apertures in said even columns are approximately centered latitudinally between two adjacent odd plate apertures in said odd columns; and wherein a majority of said odd plate apertures are approximately centered latitudinally between two adjacent ones of said even plate apertures.

9. An apparatus according to claim 1 further comprising:

a covering coupled to said upwardly facing plate surface.

10. An apparatus according to claim 9, wherein said covering includes a plurality of fingers.

11. An apparatus according to claim 1 further comprising:

a surface section floor.

* * * * *